US008209798B2

(12) United States Patent
Schwartz et al.

(10) Patent No.: US 8,209,798 B2
(45) Date of Patent: Jul. 3, 2012

(54) CRIB

(75) Inventors: David Schwartz, Chicago, IL (US); Peter D. McWeeny, Chicago, IL (US); Jason Grochowski, Crown Point, IN (US)

(73) Assignee: Baby Revolution LLC, Chicago, IL (US)

( * ) Notice: Subject to any disclaimer, the term of this patent is extended or adjusted under 35 U.S.C. 154(b) by 0 days.

(21) Appl. No.: 12/765,058

(22) Filed: Apr. 22, 2010

(65) Prior Publication Data

US 2011/0258776 A1 Oct. 27, 2011

(51) Int. Cl.
*A47D 7/02* (2006.01)

(52) U.S. Cl. ..... 5/100; 5/93.1; 5/424; 5/425; 5/427

(58) Field of Classification Search ..... 5/100, 424, 5/425, 427, 428, 429, 93.1, 93.2
See application file for complete search history.

(56) References Cited

U.S. PATENT DOCUMENTS

| | | | | |
|---|---|---|---|---|
| 1,695,571 | A | 12/1928 | Baxter | |
| 2,011,909 | A | 8/1935 | Rece | |
| 2,130,703 | A * | 9/1938 | Wylie et al. | 5/97 |
| 2,464,866 | A | 3/1949 | Holtz | |
| 3,044,078 | A | 7/1962 | Hamilton | |
| D193,326 | S | 8/1962 | Hamilton et al. | |
| 3,763,507 | A * | 10/1973 | Propst | 5/100 |
| 4,692,953 | A | 9/1987 | Fetters | |
| 4,703,524 | A | 11/1987 | Brunner et al. | |
| 4,811,436 | A | 3/1989 | Schwartz | |
| 4,819,285 | A | 4/1989 | Fetters | |
| 4,882,799 | A | 11/1989 | Shapiro | |
| 5,038,427 | A | 8/1991 | Golden | |
| 5,172,435 | A | 12/1992 | Griffin et al. | |
| 5,542,135 | A | 8/1996 | Ozrovitz et al. | |
| 5,742,959 | A | 4/1998 | Froelich | |
| 5,845,349 | A | 12/1998 | Tharalson et al. | |
| 6,167,580 | B1 | 1/2001 | Draheim et al. | |
| 6,487,735 | B1 * | 12/2002 | Jacques, II et al. | 5/424 |
| 7,055,194 | B2 | 6/2006 | Arthur | |

(Continued)

FOREIGN PATENT DOCUMENTS

| | | | |
|---|---|---|---|
| GB | 2166047 A | * | 4/1986 |
| WO | 2008/129294 | | 10/2008 |
| WO | WO 2008/129294 A2 | | 10/2008 |

OTHER PUBLICATIONS

International Search Report, PCT/US2011/00467, Baby Revolution LLC, The International Searching Authority/US Patent Office, May 9, 2011.

*Primary Examiner* — Robert G Santos
*Assistant Examiner* — Brittany Wilson
(74) *Attorney, Agent, or Firm* — Clifford W. Browning; Krieg DeVault LLP

(57) ABSTRACT

A crib is provided having a plurality of sides, at least one side being made of a flexible material. One or more sides may be retractable. The retractable side may have a first edge and a second edge each being captured in a track. The crib also includes at least one locking mechanism and an actuating mechanism for releasing the locking mechanism. When the actuating mechanism is actuated, the retractable side moves along the track from a locked first position where the retractable side is fully extended into a second position where the retractable side curves under the base or rolls up into a spool.

15 Claims, 15 Drawing Sheets

U.S. PATENT DOCUMENTS

| | | | | |
|---|---|---|---|---|
| 7,062,806 | B2 | 6/2006 | Merlin | |
| 7,216,379 | B2 | 5/2007 | Tharalson et al. | |
| 7,415,740 | B1 | 8/2008 | Kemper | |
| 7,640,606 | B2 | 1/2010 | Flannery et al. | |
| 7,793,368 | B2 | 9/2010 | Burrell, IV | |
| 7,908,689 | B2 * | 3/2011 | Flannery | 5/430 |
| 2005/0241065 | A1 | 11/2005 | Merlin | |
| 2008/0115268 | A1 | 5/2008 | McCluskey et al. | |
| 2010/0000018 | A1 | 1/2010 | Eleonori et al. | |

* cited by examiner

CRIB

BACKGROUND

1. Field of the Application

The present application relates generally to a crib, and more particularly, to a baby crib with sides made of a flexible, breathable material.

2. Description of the Related Art

Many manufacturers sell cribs with slats made of wood or other solid materials. Among other concerns, wood-slatted cribs can cause injuries to babies who bump their heads or other body parts against the hard slats, or who get their limbs caught between the slats. Accordingly, it would be desirable to design a crib with soft, breathable sides, such that the dangers of wood-slatted cribs would be avoided.

In addition, some wood-slatted cribs have a drop-down side that makes it easier for a parent to place the baby into the crib, soothe the baby, or remove the baby from the crib. However, cribs with drop-down sides have increasingly become a safety concern because the drop-down side can separate from the rest of the crib, creating a gap that has led to an alarming number of strangulation deaths.

Accordingly, it would be desirable to design a crib with flexible, breathable sides, at least one of which is retractable. If a baby rolls face-first against one of the sides, there would be no suffocation risk because of the breathable material, and there would also be no risk of harm from a baby bumping into hard wood or having a limb get caught between the slats of the crib.

In addition, many manufacturers sell "play yards" that have soft, breathable sides, but that can only accommodate a very thin, non-full size crib mattress to prevent a baby from being trapped in a gap between the sides and the mattress. Moreover, those products have sides which collapse in order to fold and store them in a small space. Accordingly, it would be desirable to design a crib with soft, breathable sides that can accommodate a full size crib mattress and which has a system to prevent any gaps between the mattress and the sides.

SUMMARY

The present application provides a crib. The crib includes a base and a plurality of sides, at least one of the plurality of sides comprising a flexible material and being retractable, the retractable side including a first and second edge, and the first edge being captured within a first track and the second edge being captured within a second track. The crib further includes at least one locking mechanism that maintains the retractable side in a first position, and at least one actuating mechanism that releases the locking mechanism and allows the retractable side to move. The first and second edges of the retractable side remain within the tracks when the retractable side moves from the first position to a second position.

In another embodiment, the crib includes a base and a plurality of sides, at least one of the plurality of sides comprising a flexible material and being retractable, and a corner post attached to each of the sides that abut the retractable side, the corner posts each having a track. The retractable side has a first edge and a second edge that move along the tracks. The crib further includes at least one locking mechanism that maintains the retractable side in a first position, and at least one actuating mechanism that releases the locking mechanism and allows the retractable side to move. The retractable side is moveable along the tracks from the locked first position where the retractable side is fully extended into a locked second position where the retractable side is retracted, and the first and second edges remain within the tracks at all times when the retractable side moves from the first position to the second position.

In yet another embodiment, the crib includes a mattress supported by a base, a plurality of sides with at least one of the plurality of sides comprising a flexible material, and the plurality of sides each including fixed edges. The crib also includes a plurality of exterior panels that extend to approximately the same height as the mattress, thereby preventing gaps between the mattress and the plurality of sides.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

BRIEF DESCRIPTION OF THE DRAWINGS

Exemplary embodiments of the invention are described herein with reference to the drawings, in which.

DETAILED DESCRIPTION

Figure 2:
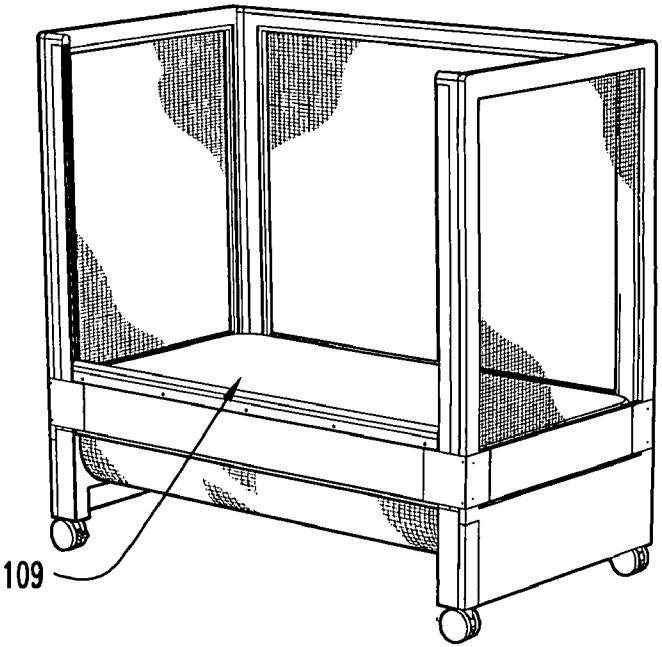
FIG. 2 is a perspective view of the crib shown in FIG. 1 with one side retracted.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present application provides a crib having sides made of a flexible, breathable material, where at least one of the sides is retractable. The retractable side may be one or more of any of the sides of the crib. The crib may be rectangular, circular, or may take any other shape. In order to move the retractable side, a user may activate an actuating mechanism that may release a locking mechanism, preventing a child from retracting the side on his or her own. Once unlocked, the retractable side may slide along a track and either curve under the base or retract onto a spool which collects and rolls up the retractable side. The retractable side may move in a vertical direction or in a horizontal direction. There may be several positions at which the side could lock into place, from completely opened to completely closed, or at several intermediate positions in between.

Figure 1:
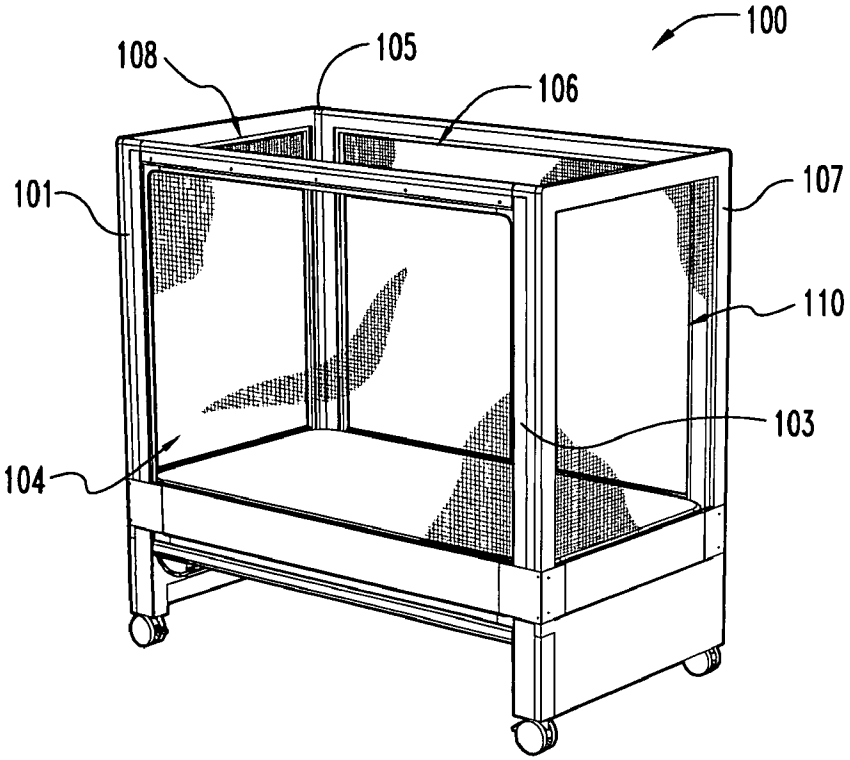
FIG. 1 is a perspective view of a crib of the present application.
Figure 3:
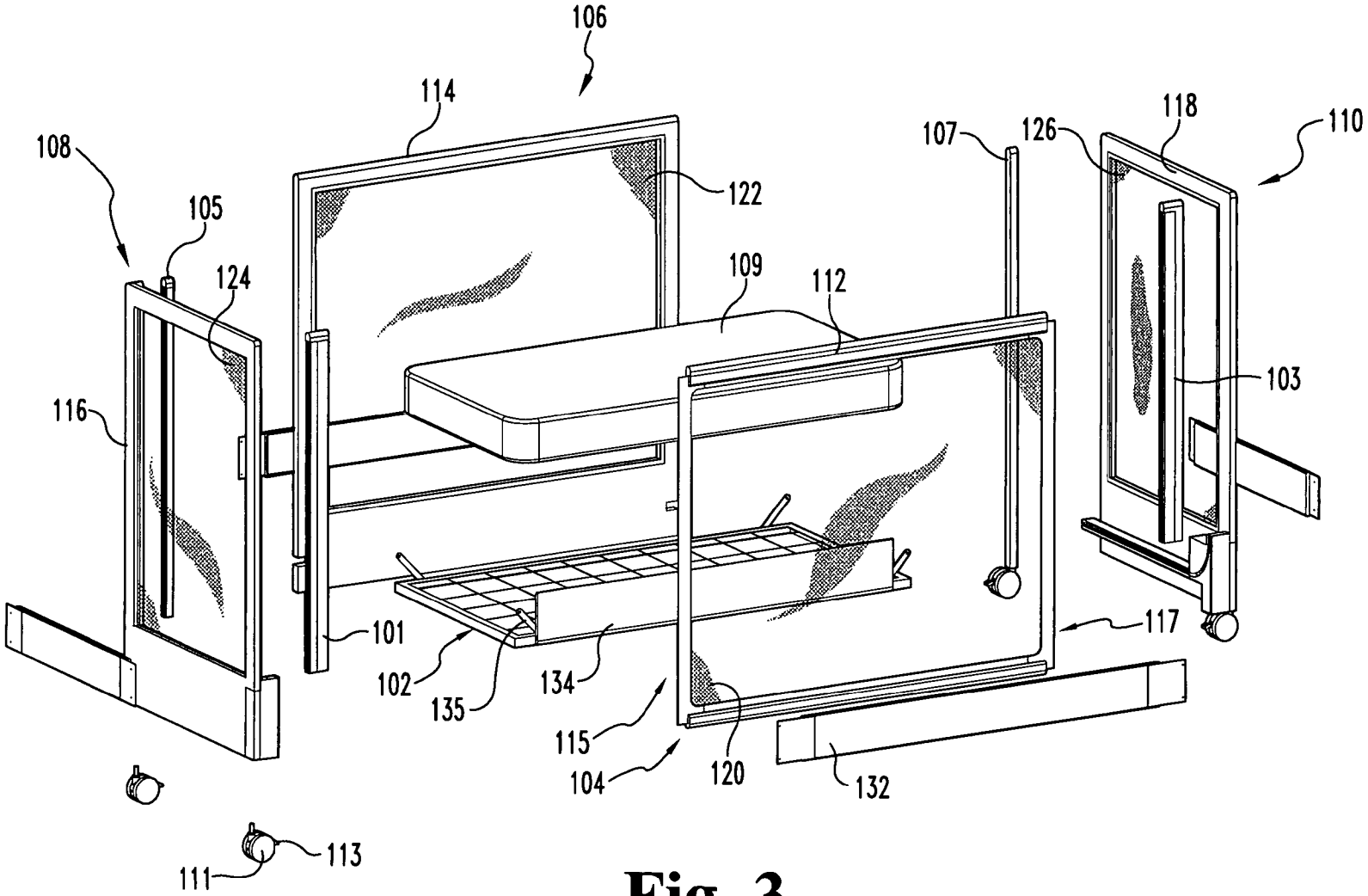
FIG. 3 is an exploded view of the crib shown in FIG. 1.

Turning now to the drawings, FIG. 1 shows an exemplary crib 100 of the present application. The crib 100 may include a plurality of corner posts 101, 103, 105, and 107, a base 102, and a plurality of sides 104, 106, 108, and 110 attached to the plurality of corner posts. Alternatively, the sides 104, 106, 108, 110 may be directly attached to each other in any suitable manner. In an exemplary embodiment, the crib 100 may include four sides and four corner posts. The base 102 and each side may be generally rectangular in shape, or may take any suitable shape. The base 102 may be a bed frame, as shown in FIG. 3, and may accommodate a mattress 109. The base 102 may be constructed of any type of metal, wood, plastic, or fabric, for example. The base 102 may be attached to corner posts 101, 103, 105, and 107 or sides 104, 106, 108, and 110 at a distance above the floor or ground. The base 102 may further be adjustable to change the height of the mattress 109 within the crib 100, which is described in detail below with respect to FIGS. 13A-13C. Thus, the base 102 and mattress 109 can be raised, such as for younger babies, or lowered, for babies that can pull themselves into a standing position.

Each side 104, 106, 108, and 110 may comprise an outer frame 112, 114, 116, 118, as shown in FIG. 3, which surrounds a taut, breathable, flexible side 120, 122, 124, 126. The material of the flexible sides may be stitched to the outer frames 112, 114, 116, and 118. Alternatively, the flexible sides 120, 122, 124, 126 may be attached to the outer frames by any suitable fastening means, such as adhesive or plastic molding, for example. The outer frames 112, 114, 116 and 118 may be made of metal, wood, plastic, or fabric, for example. The flexible sides 120, 122, 124, 126 may be made of a flexible, breathable, material, such as cotton, nylon, or synthetic material, for example. The flexible sides 120, 122, 124, 126 may be contained within or flush against the base 102, leaving little or no gap between the mattress 109 and the sides 104, 106, 108, 110 of the crib 100.

Figure 4:
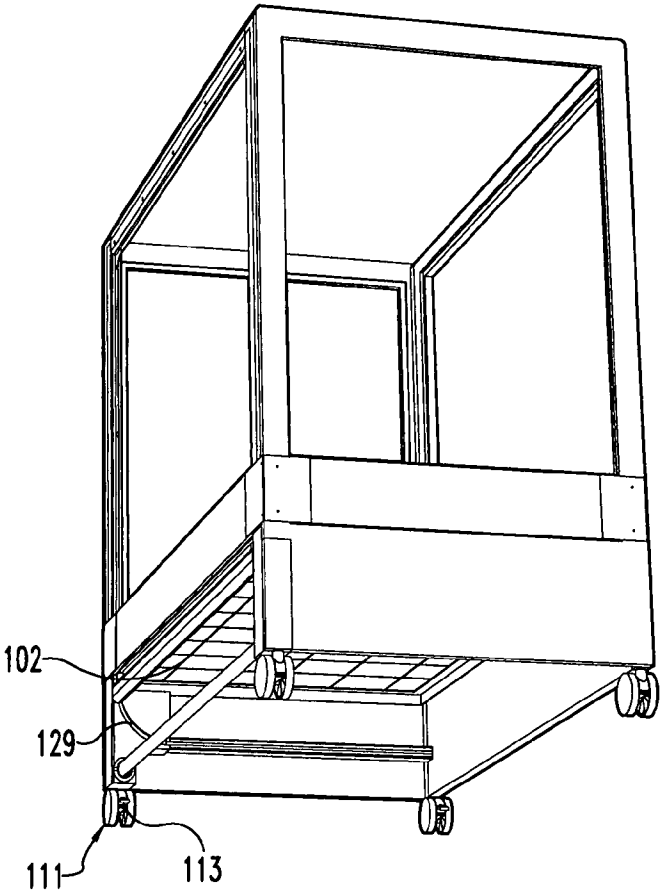
FIG. 4 is a bottom perspective view of the crib shown in FIG. 1.
Figure 5:
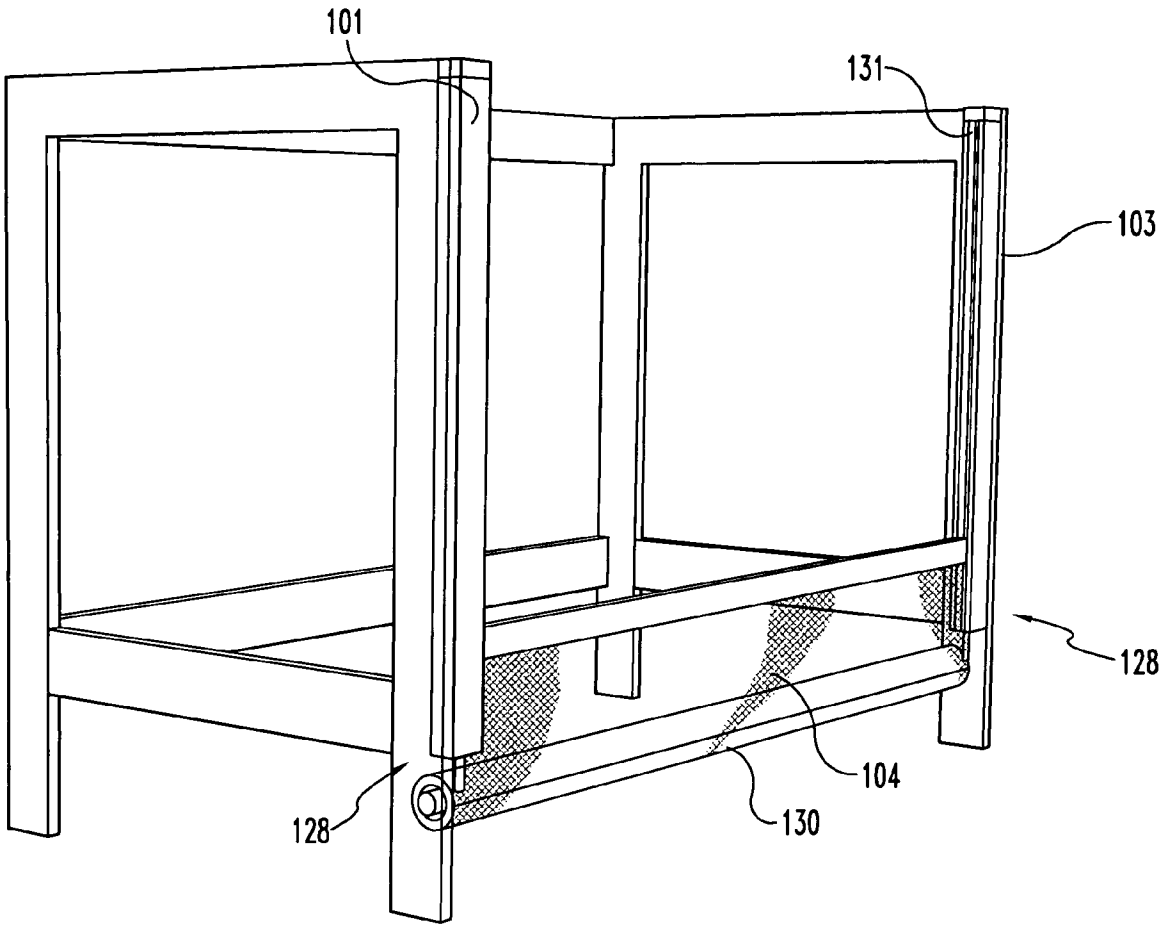
FIG. 5 is an alternate embodiment of the retractable side of the crib shown in FIG. 1.
Figure 6B:
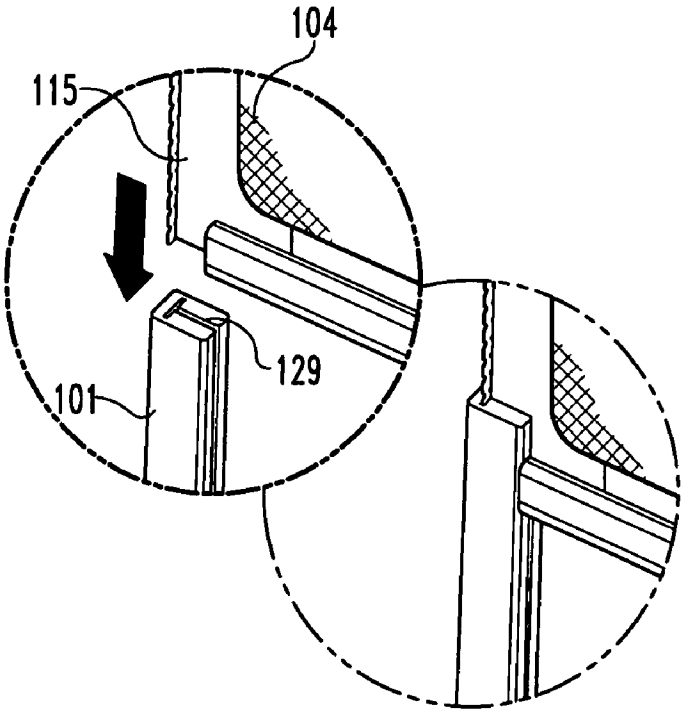
FIG. 6B is a close-up view of one embodiment of a retractable side secured to a corner post on one side of the crib shown in FIG. 1.
Figure 6A:
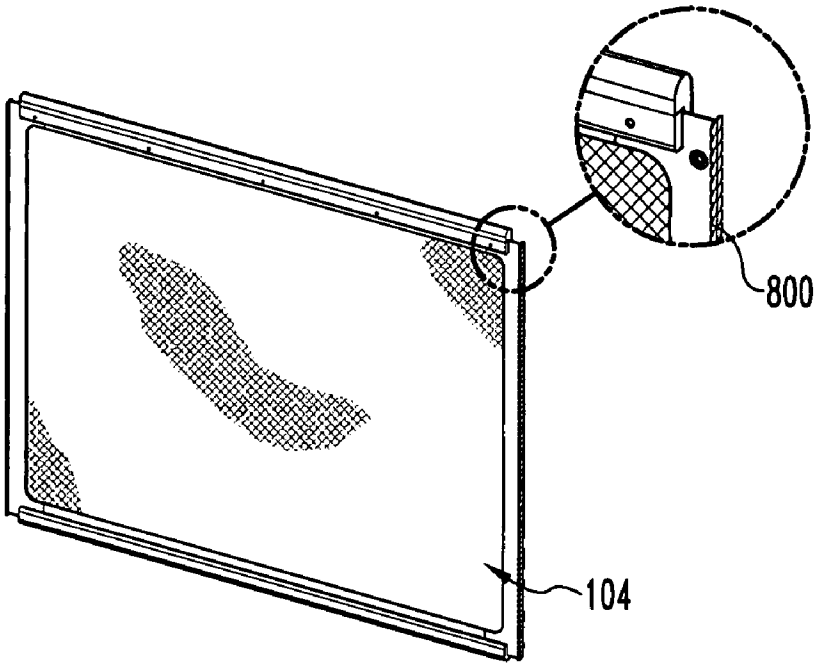
FIG. 6A is a front perspective view of one embodiment of a retractable side of the crib shown in FIG. 1.

As discussed above, the crib 100 may include at least one retractable side 104 to facilitate the placement and removal of a child into and out of the crib. For example, as shown in FIGS. 1 and 2, side 104 may be retractable. In another embodiment, a plurality of the sides may be retractable, such as both sides 104 and 106, for example. The corner posts 101, 103 may each include one or more tracks or slots 129, 131 located within the corner posts to accommodate and capture first and second edges 115, 117 of retractable side 104, which is best seen in FIGS. 6A and 6B. The tracks 129, 131 guide the movement of the retractable side 104. The tracks 129, 131 may extend underneath the base 102, as shown in FIG. 4, to guide the retractable side 104 underneath the base when the retractable side 104 is retracted. In an alternative embodiment, shown in FIG. 5, the tracks 129, 131 may only extend to a lower end 128 of the corner posts 101, 103, and the retractable side 104 may retract onto a spool 130 which collects and rolls up the retractable side 104.

In another embodiment, where side 106 is retractable, tracks may be located in corner posts 105 and 107 to capture the edges of side 106. Further, where both sides 104 and 106 are retractable, tracks may be located in all of the corner posts 101, 103, 105, 107 to accommodate both retractable sides. In yet another embodiment, all sides 104, 106, 108, and 110 may be retractable, and more than one track may be located in each corner post 101, 103, 105, 107 to accommodate all of the retractable sides. In yet another embodiment, none of the sides 104, 106, 108, and 110 may be retractable.

One or more castors 111 may be located toward the lower end of each corner post 101, 103, 105, 107 so the crib 100 may be portable. The castors 111 may include locking mechanisms 113 to lock the castors in place. The castors 111 may also be removable from the corner posts 101, 103, 105, 107.

Referring back to FIG. 3, the base 102 may include a plurality of interior panels, such as panel 134, that may be rectangular, and that may attach to the base 102 and extend to approximately the same height as the mattress 109. The interior panels 134 will surround the mattress 109 snugly so there are little or no gaps between the mattress 109 and the panels 134. The interior panels 134 may be made of metal, wood, or plastic, for example.

The crib 100 may further include a plurality of outer panels 132 that may extend to approximately the same height as the mattress 109, further ensuring that there are little or no gaps between the flexible sides 120, 122, 124, 126 and the mattress. The flexible sides 120, 122, 124, 126 may be located between the interior panels 134 and the outer panels 132. The outer panels 132 may be made of metal, wood, plastic, or fabric, for example. The base 102 may also include one or more connecting members 135 for attaching the base 102 to the corner posts 101, 103, 105, 107.

The outer frame 112 of the retractable side 104 may be attached to the first edge 115, the second edge 117, a third edge 119, and a fourth edge 121 of retractable side 104. The retractable side 104 may be attached to the corner posts 101, 103 at tracks 129, 131, as discussed above. In one embodiment, shown in FIGS. 6A and 6B, the first and second edges 115, 117 may include a perpendicular flat portion 133, and the tracks 129, 131 may be T-shaped to accommodate each of the first and second edges 115, 117 of the retractable side 104. The first and second edges 115, 117 of the side 104 may slide within the tracks 129, 131 as the retractable side 104 is being extended and retracted.

Figure 7B:
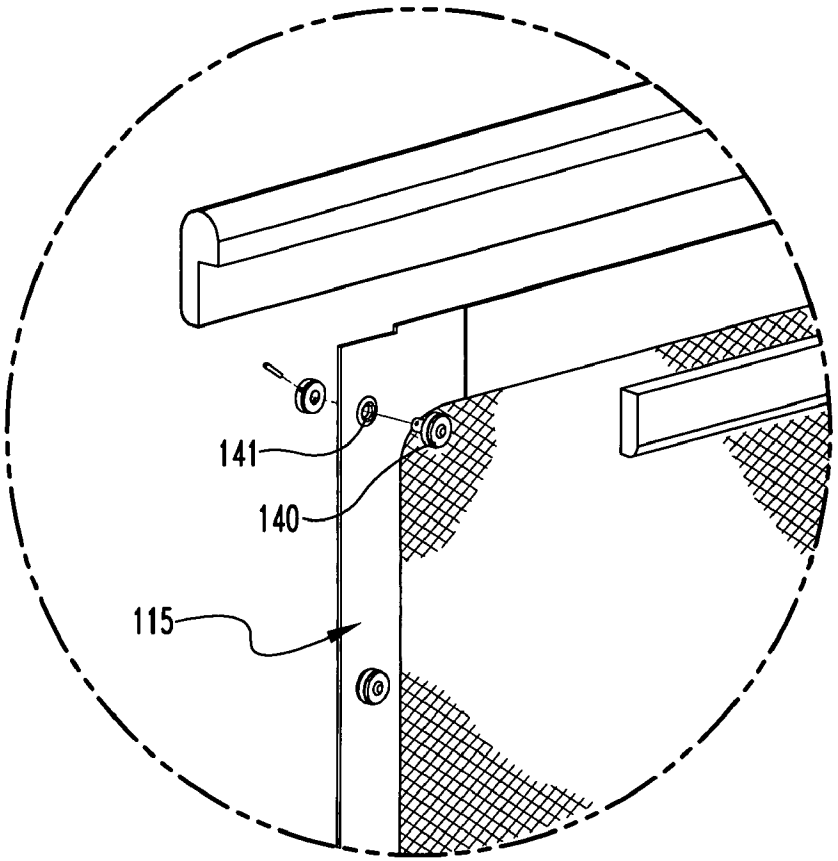
FIG. 7B is a close-up view of the side of the crib shown in FIG. 7A.
Figure 7A:
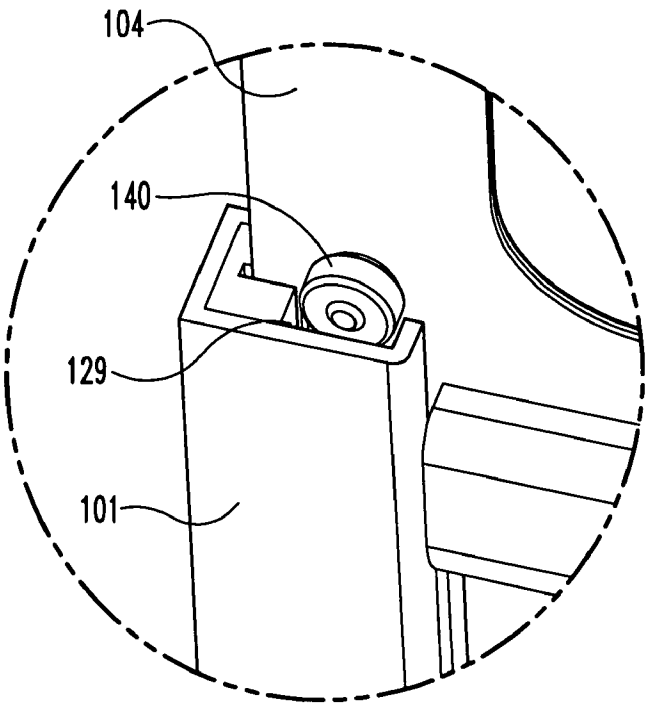
FIG. 7A is a close-up view of another embodiment of a retractable side secured to a corner post on one side of the crib shown in FIG. 1.

In another embodiment, the tracks 129, 131 may be shaped so as to accommodate wheels 140, as shown in FIGS. 7A and 7B. The wheels 140 may be secured to the first and second edges 115, 117 by a fastener 141, such as a grommet, and may facilitate movement of the side 104 within the tracks 129, 131. Alternatively, any suitable fastener may secure the wheels to the first and second edges 115, 117.

It should be understood that the retractable side 104 may be attached to the corner posts 101, 103 in any suitable manner so as to allow the edges 115, 117 of the side 104 to move within the tracks 129, 131.

The crib 100 may further include a locking mechanism and an actuating mechanism to release the locking mechanism, examples of which are shown in FIGS. 8-11. It should be understood that any suitable locking mechanism or actuating mechanism may be used with the crib 100.

Figure 8:
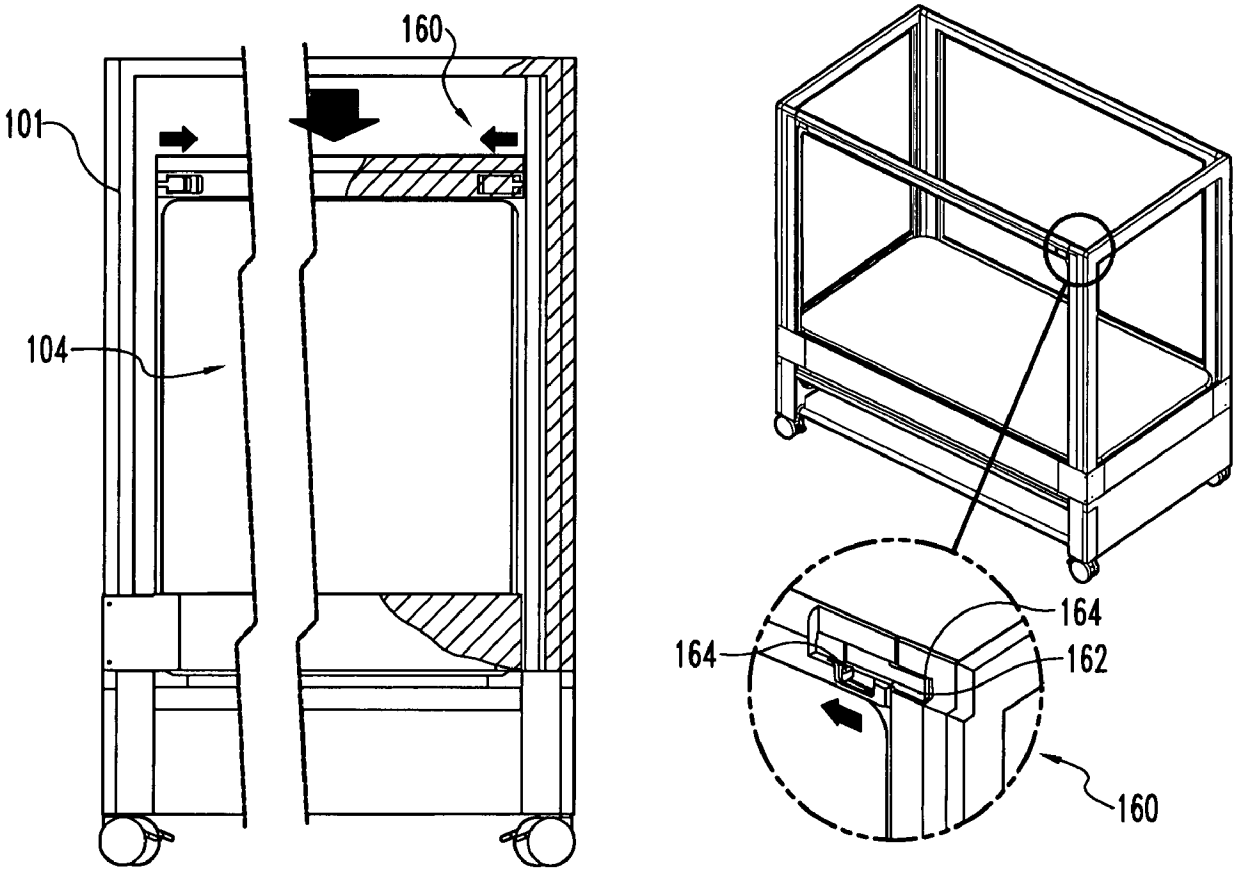
FIG. 8 is a close-up view of an example locking mechanism and actuating mechanism that may be used with the crib shown in FIG. 1.

In one example locking mechanism, shown in FIG. 8, a locking mechanism 160 may be used to lock the retractable side 104 in place. The locking mechanism 160 may include a locking pin 162 connected to an actuating mechanism 164 located on each side of the third edge 119 of the retractable side 104. The actuating mechanisms 164 may comprise buttons, for example. The locking pins 162 may be spring-loaded locking pins, for example. The locking pins 162 may engage holes 166 located in the corner posts 101, 103 or sides 108, 110. A plurality of holes 166 may be located along the corner posts 101, 103 so the retractable side 104 can lock at various positions along the corner posts 101, 103, such as the positions shown in FIGS. 12A-12D.

In operation, when a user depresses both of the actuating mechanisms 164 simultaneously, the locking pins 162 are released from the holes 166 and the retractable side 104 is free to move. In the example embodiment shown in FIG. 8, the retractable side 104 may move vertically. In an alternate embodiment, the retractable side 104 may move horizontally. To lock the retractable side 104 back into place, the user moves the retractable side 104 to a position where the locking pins 162 are aligned with a set of holes 166, and releases the actuating mechanism 164 so the locking pins 162 engage the holes 166.

Figure 9A:
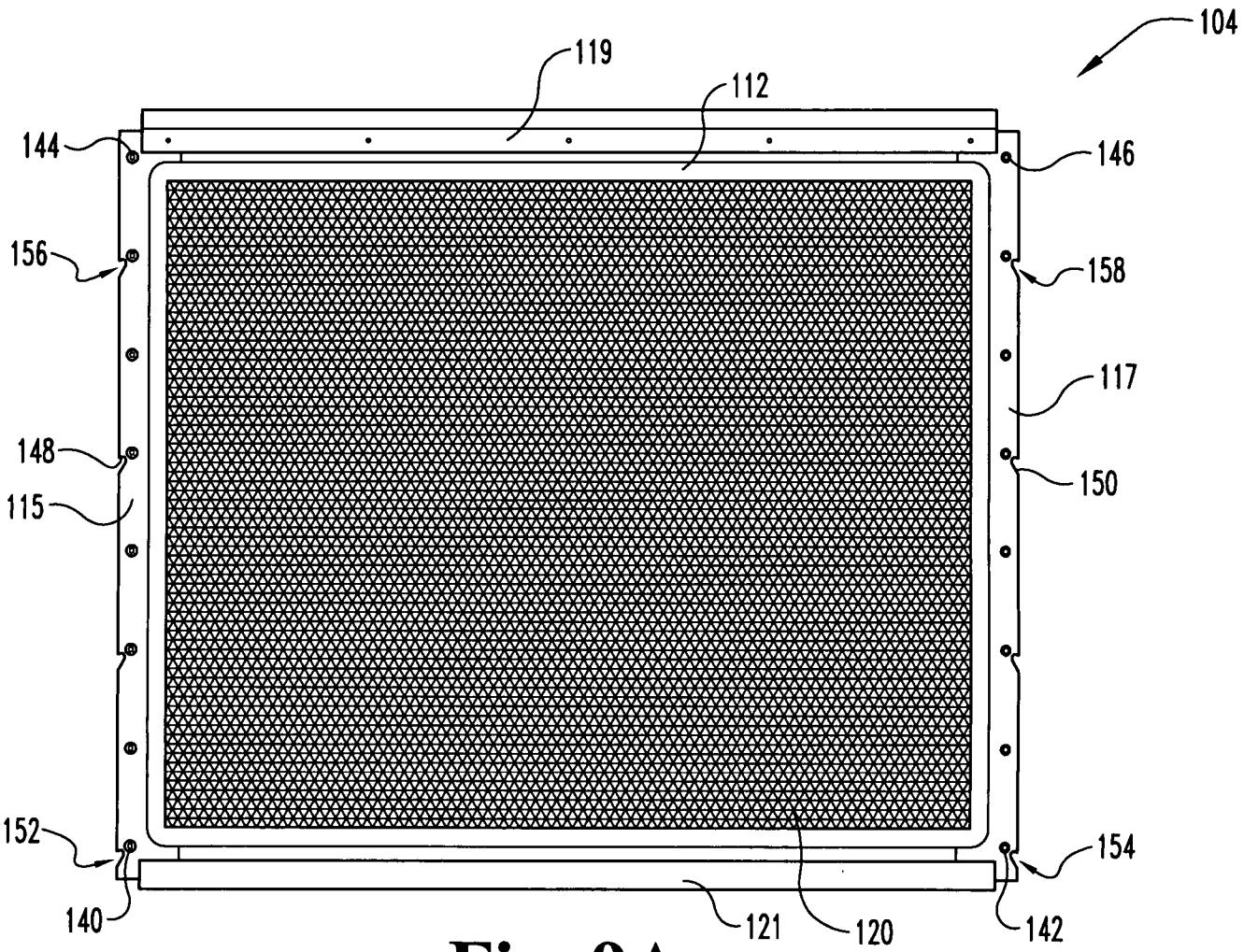
FIG. 9A is a front view of another embodiment of a side of the crib having an alternate locking mechanism.
Figure 9B:
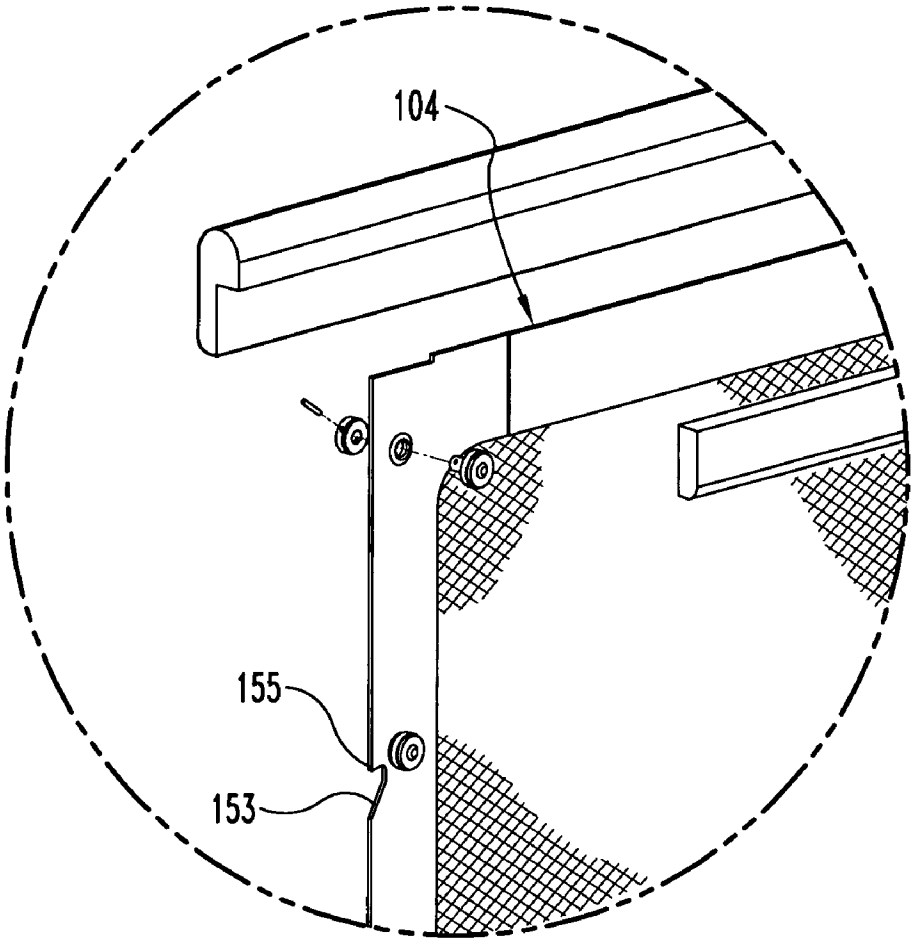
FIG. 9B is a close-up view of the side of the crib shown in FIG. 9A.
Figures 10A, 10B, 10C:
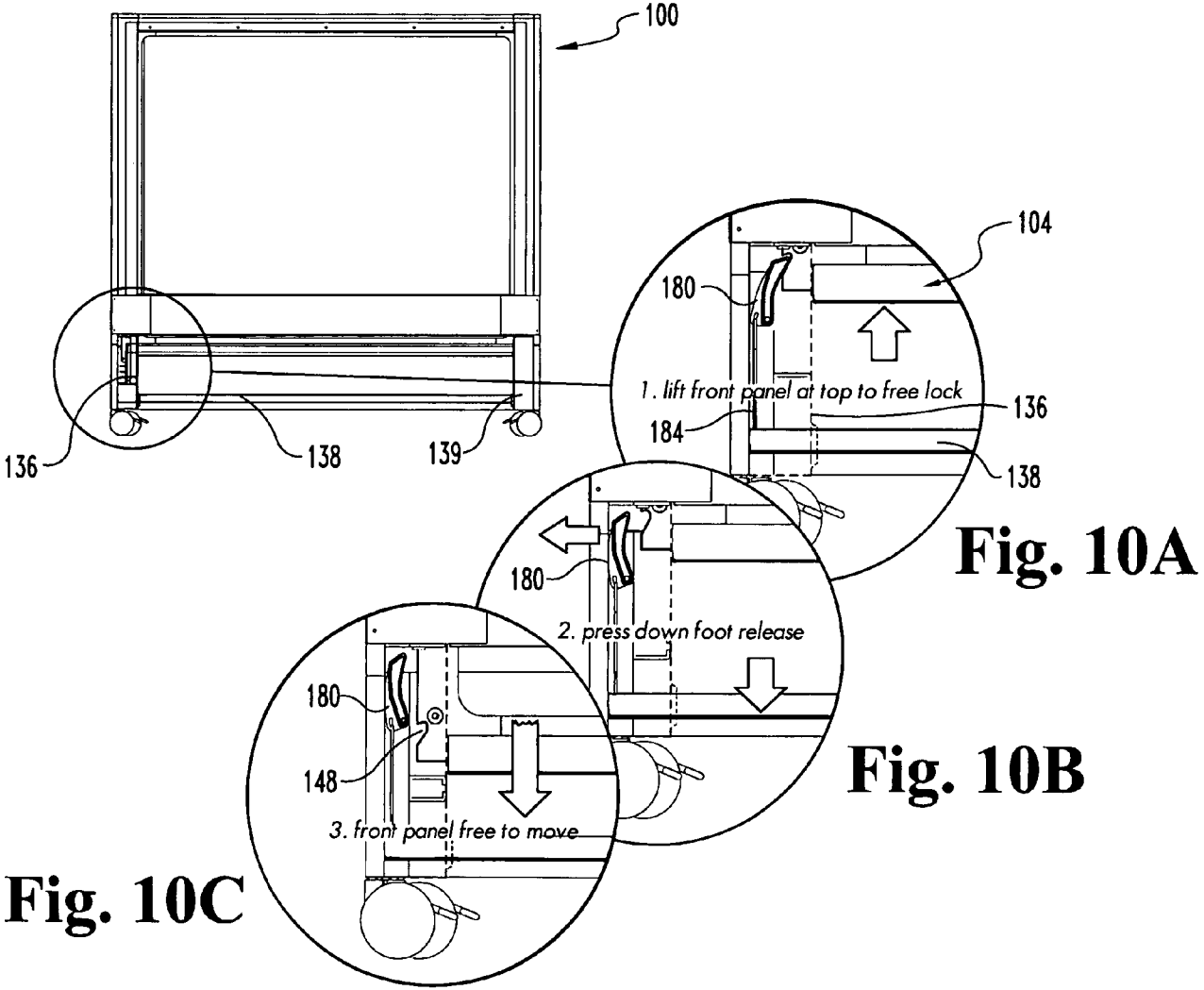
FIGS. 10A-10C are a close-up views of the locking mechanism shown in FIG. 8 and an alternate actuating mechanism that may be used with the crib shown in FIG. 1.

In another embodiment, shown in FIGS. 9 and 10, an alternate locking mechanism and actuating mechanism may be used with the crib 100. The first and second edges 115 and 117 of the retractable side 104 may include at least one first set of lock stops 152, 154. The first set of lock stops 152, 154 may engage with a pair of locking arms 180, 182 located near the bottom of the crib 100, which are shown in detail in FIGS. 10A-10C, and which allow the retractable side 104 to lock into a first or up position, in which the retractable side 104 is fully extended. The retractable side 104 may also be locked in a second or retracted position, in which the retractable side 104 is retracted and partially located either underneath the base 102 or partially rolled up into a spool 130.

The first set of lock stops 152, 154 may be located toward the fourth edge 121 of the retractable side 104. The first set of lock stops 152, 154 may be located at the same height on each of the first and second edges 115, 117 of the retractable side 104 to ensure that the third edge 119 of the retractable side 104 stays even and parallel to the ground during adjustment. Thus, the first and second edges 115, 117 of the retractable side 104 will move together at the same rate.

A plurality of additional similarly shaped and spaced apart lock stops may be located along the first and second edges 115, 117, such as lock stops 156, 158. The additional lock stops allow the retractable side 104 to lock in at least one intermediate position, which is located between the first position and the second position. Examples of intermediate positions are shown in FIGS. 12B-12C.

As discussed above, the outer frame 112 may also include a plurality of wheels, such as first set of wheels 140, 142 affixed to the first and second edges 115, 117. The first set of wheels 140, 142 may travel along the tracks 129, 131 located within the corner posts 101, 103 to guide movement of the retractable side 104. The first set of wheels 140, 142 may be located toward the fourth edge 121 of the retractable side 104, and a second set of wheels 144, 146 may be located toward the third edge 119. The wheels 140, 142, 144, 146 may be attached to the first and second edges 115, 117 of the retractable side 104 by a fastener, such as fastener 141. The sets of wheels 140, 142, and 144, 146 may be located at the same height on each edge 115, 117 of the retractable side 104 to ensure that both edges 115, 117 of the retractable side 104 move together at the same rate. A plurality of additional wheels, such as wheels 148, 150, may also be located along the first and second edges 115, 117 of the retractable side 104 to further facilitate movement of the retractable side 104 through the tracks 129, 131. Alternatively, the first and second edges 115, 117 of the retractable side 104 may move along the tracks 129, 131 without the use of wheels.

Each set of lock stops 152, 154 and 156, 158 may include a ramp portion 153 and a generally flat portion 155, as shown in FIG. 9B. The ramp portion 153 allows the retractable side 104 to be raised without the use of an actuating mechanism. The generally flat portion 155 holds the locking arm 180 in place so the retractable side 104 cannot move. Alternatively, the lock stops 152, 154 and 156, 158 may be shaped in any suitable manner to allow for the locking and unlocking of the retractable side 104.

Turning now to FIGS. 10A-10C, the crib 100 may include at least one locking arm 180 for locking the retractable side 104 into various positions, which are shown in FIGS. 12A-12D, including a first position 200, a second position 300, and intermediate positions 400, 402, which are located between the first position and the second position. The locking arm 180 may be a handle, for example. The locking arm 180 may be located near the bottom of side 108, below the retractable side 104. Additionally, a second locking arm 182 and may be located on near the bottom of side 110. The locking arms 180, 182 may work together with the plurality of lock stops 152, 154, 156, 158 located on the retractable side 104 to move both edges 115, 117 of the retractable side 104 at the same rate.

The crib 100 may further include an actuating mechanism 138 to release the at least one locking arm 180 from the lock stop 152 and thus unlock the retractable side 104 from the locked position. The actuating mechanism 138 may be a foot pedal, for example. In an alternative embodiment, the actuating mechanism may be contained within or attached to retractable side 104, as shown in FIG. 11, and which is described in detail below.

The locking arm 180 may be attached to the actuating mechanism 138 by a connecting member 184. The connecting member 184 may be secured to the actuating mechanism 138 by a metal, wood, or plastic rod (not shown). Alternatively, the connecting member 184 may be secured to the actuating mechanism 138 by any suitable fastening mechanism. At least one support 136 may secure the actuating mechanism 138 to the crib 100. The crib 100 may further include a second support 139 that connects to the other side of the actuating mechanism 138.

Figure 11:
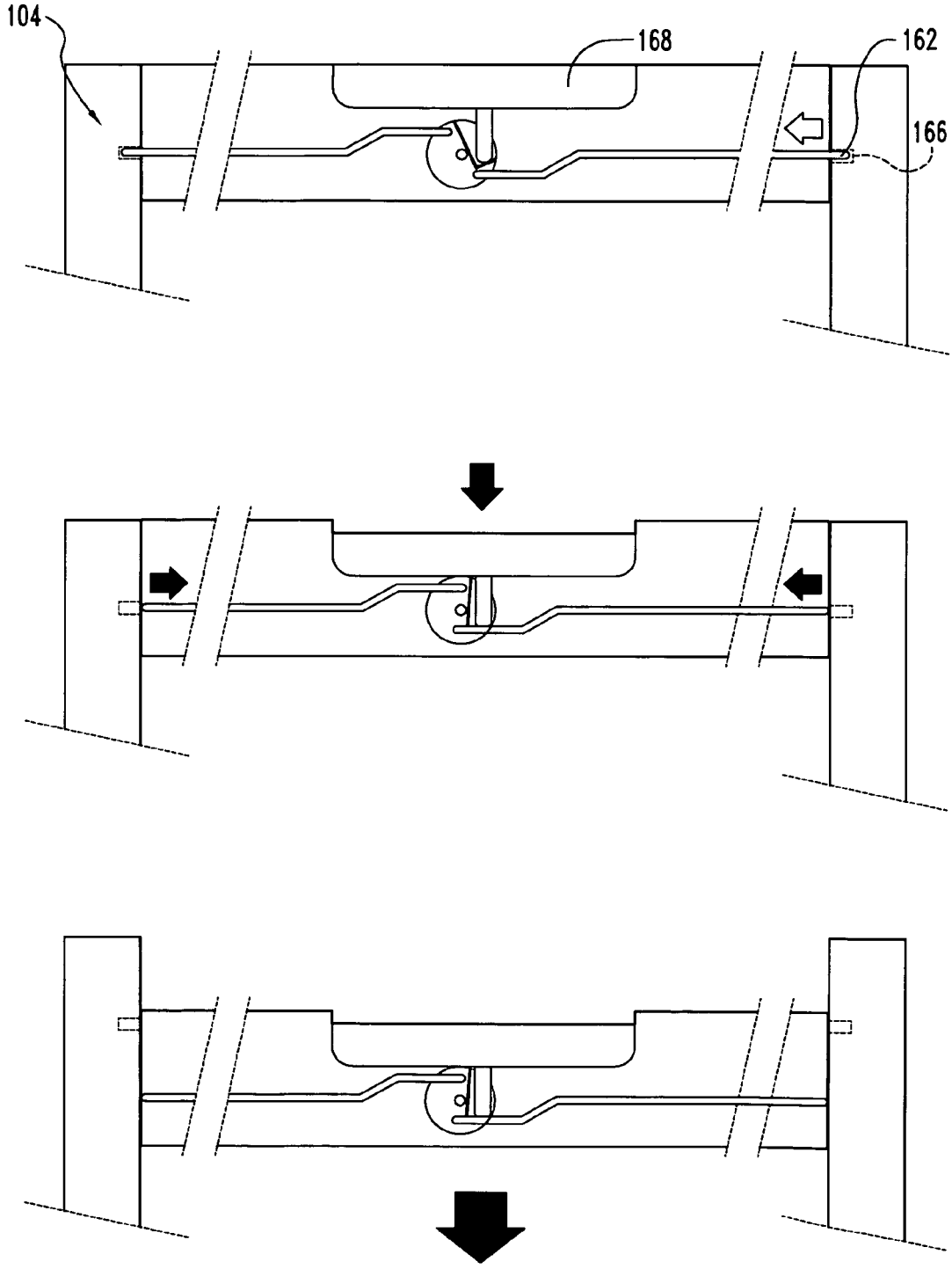
FIG. 11 is a front view of yet another example of an actuating mechanism that may be used with the crib shown in FIG. 1.

FIG. 11 shows yet another embodiment of an actuating mechanism that may be used with the crib 100. In this embodiment, a single actuating mechanism 168 controls the movement of both locking pins 162 into and out of the holes 166. The actuating mechanism 168 may comprise a button, for example. The actuating mechanism 168 may be located at the third edge 119 of the retractable side 104. Alternatively, the actuating mechanism 168 may be located anywhere on the crib 100. A user may depress the actuating mechanism 168 to release both of the locking pins 162 from the holes 166, thereby allowing the retractable side 104 to move. To lock the retractable side 104 back into place, the user may move the retractable side to a position where the locking pins 162 are aligned with a set of holes 166, and release the actuating mechanism 168 so the locking pins 162 engage the holes 166.

Figure 12D:
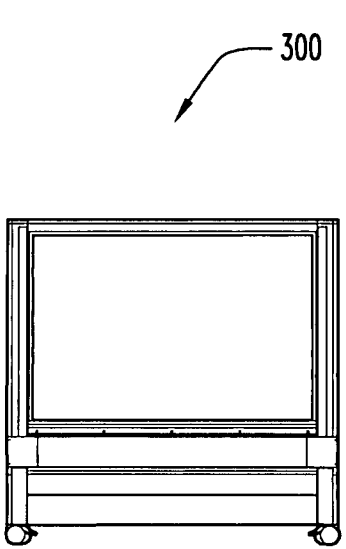
FIGS. 12A-12D are front views of different positions of the retractable side of the crib shown in FIG. 1.
Figure 12C:
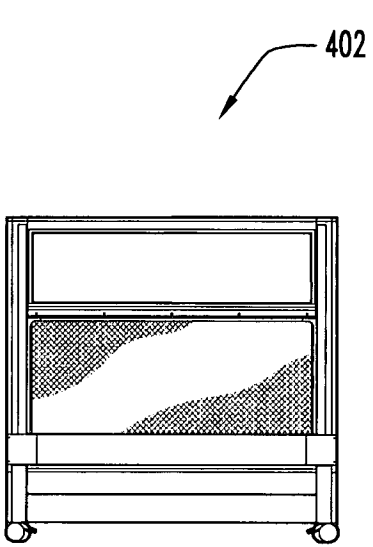
Figure 12B:
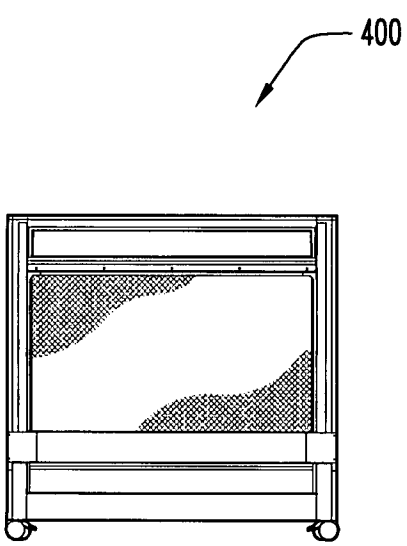
Figure 12A:
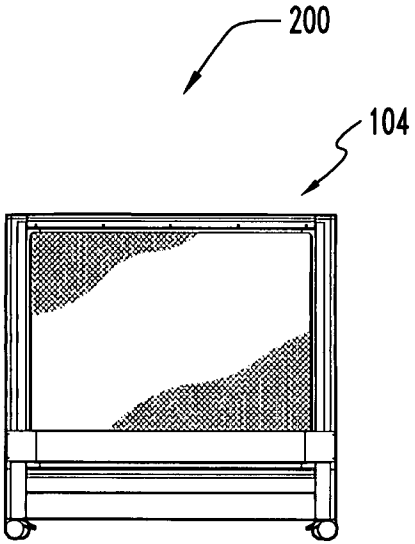

In operation, the retractable side 104 may begin locked in the fully extended first position 200, as shown in FIG. 12A, where the locking mechanism is engaged. For example, the first set of lock stops 152, 154 are engaged with the locking arms 180, 182, or the locking pins 162 are engaged with the holes 166. To release the retractable side 104, a user lifts slightly the retractable side 104 and at the same time depresses the actuating mechanism, such as actuating mechanism 160 or 138. The first and second edges 115, 117 or wheels 140, 142, 144, 146 of the retractable side 104 are then free to move within the tracks 129, 131 of the corner posts 101, 103, and the retractable side 104 may move. As the retractable side 104 moves, the outer frame 112 and flexible side 120 of the retractable side 104 may curve underneath the base 102, or retract into a spool 130 which collects and rolls up the retractable side 104. When the retractable side 104 has been moved to a desired intermediate position, such as the intermediate positions 400 or 402 shown in FIGS. 12B and 12C, a user may choose to lock the retractable side 104 in place using one of the locking mechanisms described above.

The user may then decide to move the retractable side 104 to a fully retracted second position 300, as shown in FIG. 12D. The user again lifts slightly the retractable side 104 and at the same time depresses the actuating mechanism, which simultaneously releases the locking mechanism. The edges 115, 117 or wheels of the retractable side 104 are then free to move within the tracks 129, 131 of the corner posts 101, 103, and the retractable side 104 may move. As the retractable side 104 moves, the outer frame 112 and breathable side 120 of the retractable side 104 may curve further underneath the base 102. At the second position 200, shown in FIG. 12D, the retractable side 104 is located almost completely underneath the base 102 (or alternatively almost completely rolled up into a spool 130).

To extend the retractable side 104 back into an intermediate position or the first position from the second position, a user may not need to depress the actuating mechanism. Rather, the user lifts the retractable side 104 upwardly, and the lifting motion causes the retractable side 104 to move upwardly. Alternatively, the user may depress the actuating mechanism while lifting the retractable side. Thus, moving the retractable side 104 may take only one hand. Alternatively, a user may activate the actuating mechanism to raise the retractable side 104.

The retractable side 104 may be contained within the tracks 129, 131 at all times during the raising and lowering of the retractable side, thus eliminating any gaps or separation between the retractable side 104 and the rest of the crib 100.

In another embodiment, the crib 100 may have no retractable sides. Sides 104, 106, 108, and 110 may be permanently fixed in place. The crib 100 may accommodate a full-size crib mattress 109. Referring to FIG. 3, the base 102 may include a plurality of interior panels, such as panel 134, that may be rectangular, and that may attach to the base 102 and extend to approximately the same height as the mattress 109. The interior panels 134 will surround the mattress 109 snugly so there are little or no gaps between the mattress 109 and the panels 134. The interior panels 134 may be made of metal, wood, or plastic, for example.

The crib 100 with no retractable sides may further include a plurality of outer panels 132 that may extend to approximately the same height as the mattress 109, further ensuring that there are little or no gaps between the flexible sides 120, 122, 124, 126 and the mattress. The flexible sides 120, 122, 124, 126 may be located between the interior panels 134 and the outer panels 132. The outer panels 132 may be made of metal, wood, plastic, or fabric, for example.

Figure 13C:
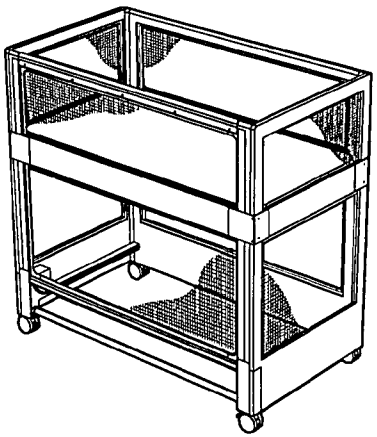
FIGS. 13A-13C are perspective views of different positions of the base of the crib shown in FIG. 1.
Figure 13B:
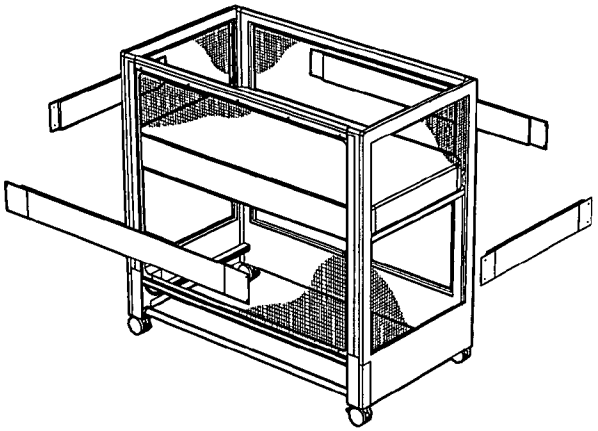
Figure 13A:
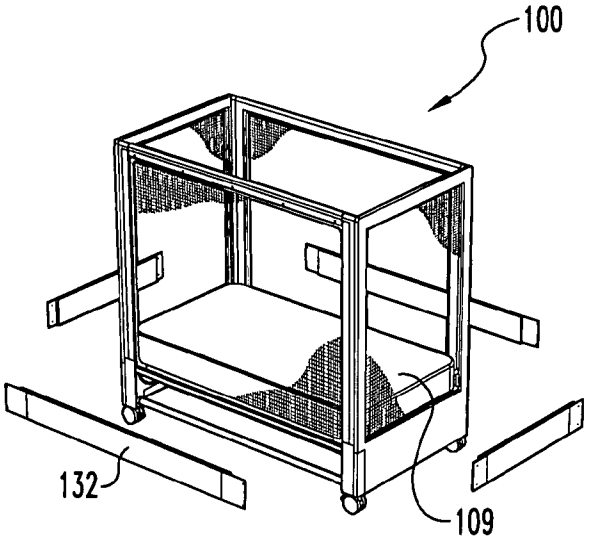

As mentioned above, the base 102 of the crib 100 may also be adjustable. To adjust the base 102, a user may remove the outer panels 132 from the sides 104, 106, 108, 110, as shown in FIG. 13A, by unfastening or unscrewing them from the corner posts 101, 103, 105, 107 or sides 104, 106, 108, 110. It should be understood that the outer panels 132 may be attached to the sides by any suitable fastening mechanism. The user may then reposition the base 102 by removing the connecting members 135 and moving the base up or down to the intermediate positions, as shown in FIG. 13B. The connecting members 135 may comprise bolts that are secured diagonally into the corner posts 101, 103. Alternatively, the connecting member 135 may comprise any suitable fastening mechanism. Once the base 102 has been adjusted to the desired position, the connecting members 135 are secured to the corner posts 101, 103, and the outer panels 132 may then be reattached to the sides 104, 106, 108, 110 by screwing them in, or by any suitable fastening mechanism, as shown in FIG. 13C. The adjustment of the base 102 allows the crib 100 to accommodate both younger babies, as well as toddlers that can pull themselves into a standing position.

Figure 14:
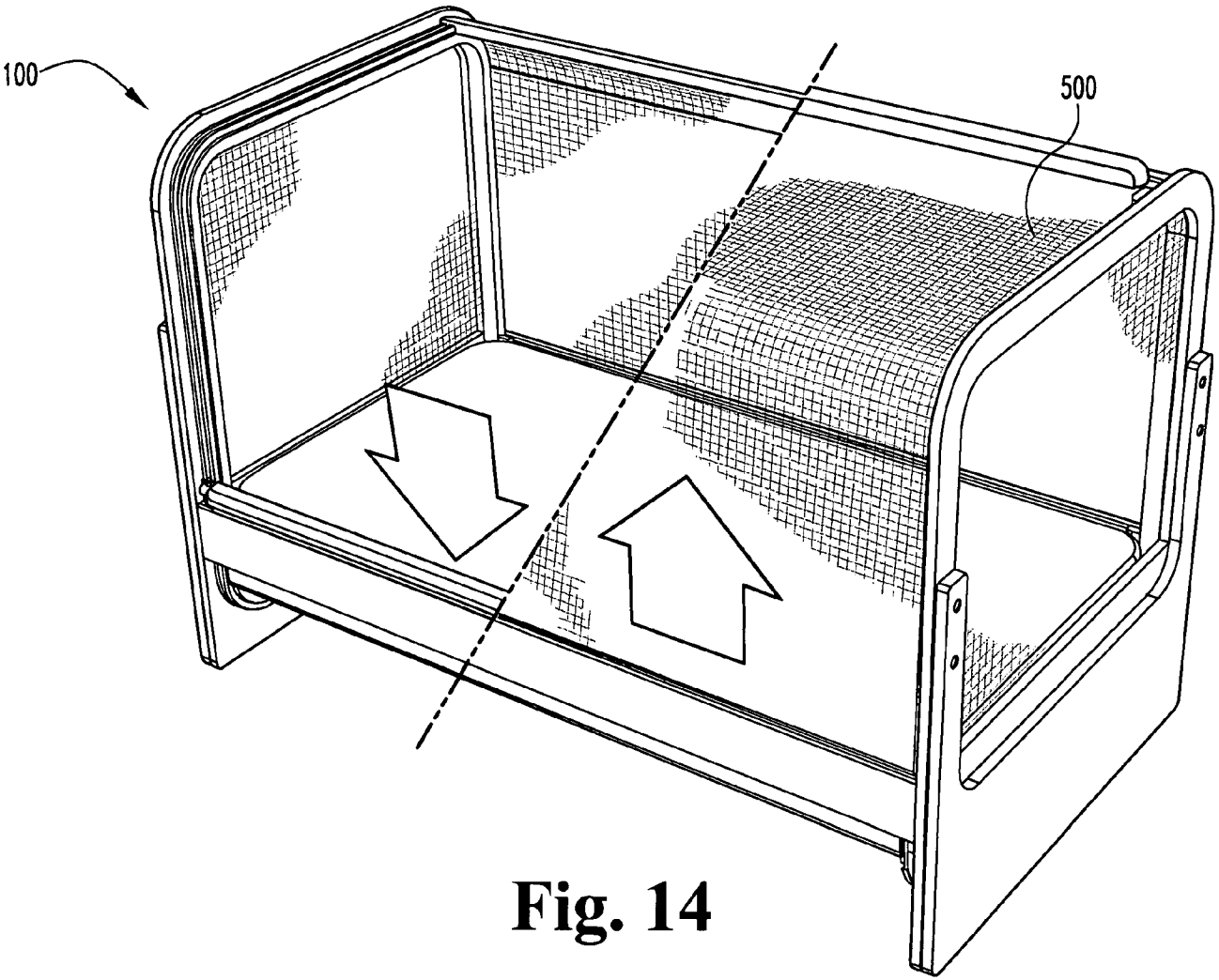
FIG. 14 is a perspective view of an alternate embodiment of the crib shown in FIG. 1.

Referring to FIG. 14, the crib 100 may also include a canopy 500 that may enclose the top of the crib 100 to prevent toddlers from hoisting themselves over the sides. The canopy 500 may be made of a flexible, breathable material, such as cotton, nylon, or synthetic material, for example. The canopy 500 may slide across the top of the crib 100 from one of side 104 or 106, and lock into place at the top of the other of sides 104 or 106. The canopy 500 may include any type of design. The canopy 500 may include a locking mechanism, such as locking mechanism 160 described above, for example, to lock the canopy in place on the crib 100. The canopy 500 may be locked at a first position at the top of the crib, a second position at the bottom of the crib, or a number of intermediate positions in between the first position and the second position.

Figure 16:
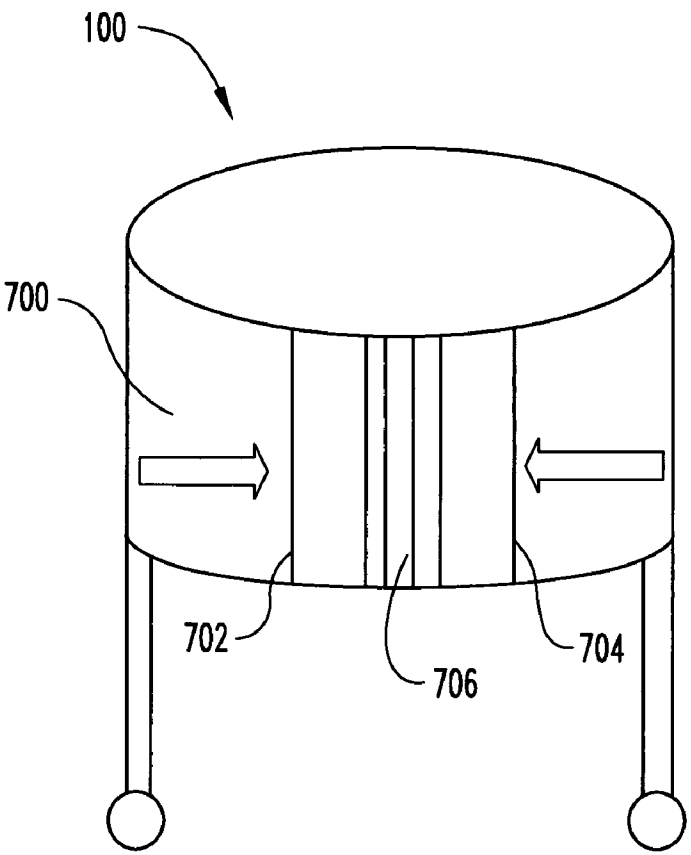
FIG. 16 is a front view of yet another alternate embodiment of the crib shown in FIG. 1.
Figure 15:
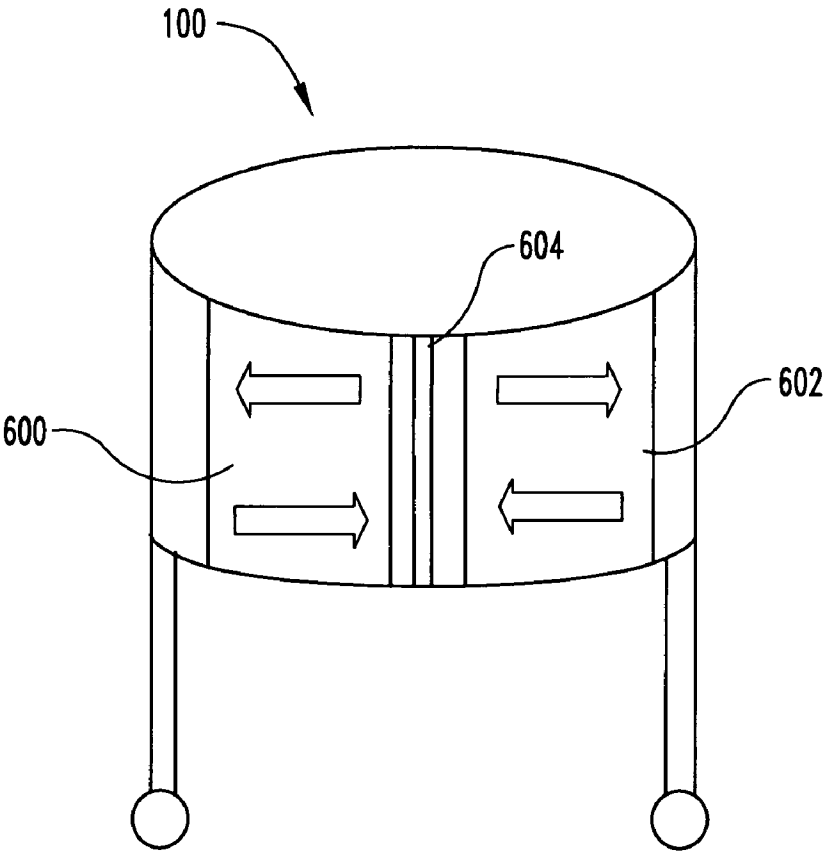
FIG. 15 is a front view of yet another alternate embodiment of the crib shown in FIG. 1.

FIGS. 15 and 16 show yet another embodiment of the crib 100. In this embodiment, the crib 100 has a circular or ovular shape. As shown in FIG. 15, the crib 100 may include at least two sides or panels 600, 602 that may move in two directions around the perimeter of the crib 100. The sides 600, 602 may comprise a flexible material. The sides 600, 602 may lock into a locking mechanism 604 located between the sides 600, 602. Alternatively, the locking mechanism 604 may be secured to the edges of the sides 600, 602, and the sides 600, 602 may lock to each other. The sides 600, 602 may be pulled toward each other in a horizontal direction to enclose the crib 100, or may be pulled apart to create an opening in the crib where a user may lift a child out of the crib 100.

FIG. 16 shows the crib 100 including at least one side 700 that extends around the entire circumference of the crib. The side 700 may comprise a flexible material. The side 700 may include a first edge 702 and a second edge 704 that are secured together to enclose the crib 100. The first and second edges 702, 704 may be secured together by a second side 706 located between the edges, such as a panel having a spool, for example. Alternatively, second side 706 may include any suitable locking mechanism. The side 700 may be pulled completely around the crib 100 to secure to second side 706 and enclose the crib, or the edges 702, 704 of the side may be pulled apart to create an opening in the crib where a user may lift a child out of the crib 100.

The crib 100 may further include additional features, such as a storage drawer at the bottom of the crib's base 102, a built-in lullaby music player, a built-in heartbeat imitator, a built-in baby monitor, or any number of other features.

Some advantages of the crib of the present application include the elimination of safety concerns of wood-slatted cribs. Further, a caregiver's ability to have access to the child, or to change the linens on the mattress, will be greatly enhanced by the existence of one or more retractable side.

Various example embodiments have been described. The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. Further, many of the elements that are described are functional entities that may be implemented as discrete or distributed components or in conjunction with other components, in any suitable combination and location.

We claim

1. A crib comprising:

a base and a plurality of sides containing flexible and breathable material, at least one of the sides being flexible and vertically retractable, the vertically retractable side including first and second edges, the first edge being continuously captured within a first track and the second edge being continuously captured within a second track, the first and second tracks curving under the base whereby the vertically retractable side is partially under the base when it is fully retracted, a mattress supported by the base, and a plurality of outer rigid panels affixed around the perimeter of the crib that extend upwardly to just below the top of the mattress, whereby the flexible and breathable material of the sides abuts the top of the mattress around its perimeter such that there are no gaps existing between the mattress and the plurality of sides into which a baby could fall or become trapped, and such that there are no hard surfaces existing along the sides of the mattress with which a baby could come into contact.

2. The crib of claim 1 and further comprising a base that is rectangular with a plurality of upright corner posts connecting the plurality of sides, the first and second tracks being located within the corner posts.

3. The crib of claim 1 wherein the first and second edges of the vertically retractable side each include at least one wheel captured within the first and second tracks that rolls along the tracks.

4. The crib of claim 1 wherein at least one of the plurality of sides is curved.

5. The crib of claim 1 and further comprising a retractable canopy that encloses the crib.

6. The crib of claim 1 wherein the base has a circular or oval shape.

7. The crib of claim 1 wherein the vertically retractable side is moveable along the tracks from a locked first position when the vertically retractable side is fully extended upright, to a locked second position when the vertically retractable side is fully or partially retracted.

8. The crib of claim 7 wherein the retractable side locks in at least one locked intermediate position that is located between the locked first position and the locked second position.

9. The crib of claim 8 wherein the locked first, the locked second, and the locked intermediate positions include at least one pin located on the first or second edges of the retractable side that engages with at least one hole to lock the retractable side in the locked first position, the locked second position, or the locked intermediate position.

10. The crib of claim 8 wherein the locked first, the locked second, and the locked intermediate positions include at least one lock stop located on the first or second edges of the retractable side that engages with a locking arm to lock the retractable side in the locked first position, the locked second position, or the locked intermediate position.

11. The crib of claim 8 wherein the retractable side is released from the locked first, the locked second, or the locked intermediate positions by at least one foot pedal.

12. The crib of claim 1 and further comprising a base that is rectangular, with the first and second tracks being located within the two sides that abut a vertically retractable side.

13. A crib comprising:

a mattress supported by a base, a plurality of vertically immovable sides containing flexible and breathable material, and a plurality of outer rigid panels affixed around the perimeter of the crib that extend upwardly to just below the top of the mattress, whereby the flexible and breathable material of the vertically immovable sides abuts the top of the mattress around its perimeter such that there are no gaps existing between the mattress and the plurality of vertically immovable sides into which a baby could fall or become trapped, and such that there are no hard surfaces existing along the sides of the mattress with which a baby could come into contact.

14. A crib comprising:

a mattress supported by a base, a plurality of vertically immovable sides containing flexible and breathable material, and a plurality of outer rigid panels affixed around the perimeter of the crib that extend upwardly to just below the top of the mattress, whereby the flexible and breathable material of the vertically immovable sides abuts the top of the mattress around its perimeter such that there are no gaps existing between the mattress and the plurality of vertically immovable sides into which a baby could fall or become trapped, and such that there are no hard surfaces existing along the sides of the mattress with which a baby could come into contact, and wherein the base and mattress move vertically, and a plurality of additional outer rigid panels are positionable around the perimeter of the crib whereby the outer rigid panels extend upwardly to just below the top of the mattress whenever the base and mattress are moved vertically.

15. A crib comprising:

a mattress supported by a base, a plurality of vertically immovable sides containing flexible and breathable material, and a plurality of outer rigid panels affixed around the perimeter of the crib that extend upwardly to just below the top of the mattress, whereby the flexible and breathable material of the vertically immovable sides abuts the top of the mattress around its perimeter such that there are no gaps existing between the mattress and the plurality of vertically immovable sides into which a baby could fall or become trapped, and such that there are no hard surfaces existing along the sides of the mattress with which a baby could come into contact, wherein the base and mattress move vertically and the outer rigid panels can be detached from the crib when the base and mattress are moved vertically and then reattached to the crib at a new height of the base and mattress, whereby the outer rigid panels will extend upwardly to just below the top of the mattress whenever the base and mattress are moved vertically.

* * * * *